US008160853B2

(12) United States Patent
Mitchell

(10) Patent No.: US 8,160,853 B2
(45) Date of Patent: Apr. 17, 2012

(54) SYSTEMS AND METHODS FOR MODELING WELLBORE TRAJECTORIES

(75) Inventor: Robert F. Mitchell, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 648 days.

(21) Appl. No.: 12/337,408

(22) Filed: Dec. 17, 2008

(65) Prior Publication Data

US 2009/0157319 A1 Jun. 18, 2009

Related U.S. Application Data

(60) Provisional application No. 61/014,362, filed on Dec. 17, 2007.

(51) Int. Cl.
*G06G 7/58* (2006.01)

(52) U.S. Cl. ..... 703/10

(58) Field of Classification Search ..... 703/10; 702/2–15

See application file for complete search history.

(56) References Cited

U.S. PATENT DOCUMENTS 6,108,011 A * 8/2000 Fowler ..... 345/441

OTHER PUBLICATIONS

J.F. Brett, A.D. Beckett, C.A. Holt, D.L. Smith, "Uses and Limitations of Drillstring Tension and Torque Models for Monitoring Hole Conditions" SPE Drilling Engineering, Sep. 1989, pp. 223-229.*

International Search Report & Written Opinion for International Patent Application No. PCT/US2008/086952; 13 pgs.; European Patent Office, Jul. 23, 2009.

Article 34 Response to the Written Opinion for International Patent Application No. PCT/US2008/086952; Sep. 4, 2009; 14 pgs.

Mitchell, Robert F. & Samuel, Robello; How Good is the Torque-Drag Model?; SPE/IADC 105068; Feb. 20-22, 2007; pp. 1-9; XP-002536069; SPE/IADC Drilling Conference; Amsterdam, The Netherlands.

Adri Schouten, Communication pursuant to Art. 94(3) EPC—EPO Application 08 862 644.5-2315 (Office Action), Jan. 20, 2011, 5 pages, European Patent Office, Munich, Germany.

Supplemental Article 34 Response to the Written Opinion for International Patent Application PCT/US2008/086952; Oct. 23, 2009; 13 pages.

Craig, Dwin M.; International Preliminary Report on Patentability; May 19, 2011; 17 pgs.; Commissioner for Patents; Alexandria, Virginia.

Sheppard, M.C., Wick, C. & Burgess, T.; Designing Well Paths to Reduce Drag and Torque; SPE Drilling Engineering; Dec. 1987; p. 344-350.

Johancsik; C.A., Friesen, D.B. & Dawson, Rapier; Torque and Drag in Directional Wells-Prediction and Measurement; Journal of Petroleum Technology; Jun. 1984; pp. 987-992.

Grinde, Jan & Haugland, Torstein; Short Radius TTRD Well with Rig Assisted Snubbing on the Veslefrikk Field; Society of Petroleum Engineers; Oct. 20-22, 2003; pp. 1-9; SPE/IADC 85328.

Schouten, Adri; European Search Report; Application No: 11173354.9-2315; Munich; Oct. 7, 2011; 5 pages.

* cited by examiner

*Primary Examiner* — Dwin M Craig
(74) *Attorney, Agent, or Firm* — Crain Caton & James

(57) ABSTRACT

Systems and methods for modeling wellbore trajectories, which can be used to model corresponding drillstring trajectories and transform the torque-drag drill string model into a full stiff-string formulation.

40 Claims, 12 Drawing Sheets

SYSTEMS AND METHODS FOR MODELING WELLBORE TRAJECTORIES

CROSS-REFERENCE TO RELATED APPLICATIONS

This application claims priority from U.S. Provisional Patent Application No. 61/014,362, filed on Dec. 17, 2007, which is incorporated herein by reference.

STATEMENT REGARDING FEDERALLY SPONSORED RESEARCH

Not applicable.

FIELD OF THE INVENTION

The present invention generally relates to modeling wellbore trajectories. More particularly, the present invention relates to the use of spline functions, derived from drill string solutions, to model wellbore trajectories.

BACKGROUND OF THE INVENTION

Wellbore trajectory models are used for two distinct purposes. The first use is planning the well location, which consists of determining kick-off points, build and drop rates, and straight sections needed to reach a specified target. The second use is to integrate measured inclination and azimuth angles to determine a well's location.

Various trajectory models have been proposed, with varying degrees of smoothness. The simplest model, the tangential model, consists of straight line sections. Thus, the slope of this model is discontinuous at survey points. The most commonly used model is the minimum curvature model, which consists of circular-arc sections. This model has continuous slope, but discontinuous curvature. In fact, the minimum curvature model argues that a wellbore would not necessarily have continuous curvature.

Analysis of drillstring loads is typically done with drillstring computer models. By far the most common method for drillstring analysis is the "torque-drag" model originally described in the Society of Petroleum Engineers article "Torque and Drag in Directional Wells—Prediction and Measurement" by Johancsik, C. A., Dawson, R. and Friesen, D. B., which was later translated into differential equation form as described in the article "Designing Well Paths to Reduce Drag and Torque" by Sheppard, M. C., Wick, C. and Burgess, T. M.

Torque-drag modeling refers to the torque and drag related to drillstring operation. Drag is the excess load compared to rotating drillstring weight, which may be either positive when pulling the drillstring or negative while sliding into the well. This drag force is attributed to friction generated by drillstring contact with the wellbore. When rotating, this same friction will reduce the surface torque transmitted to the bit. Being able to estimate the friction forces is useful when planning a well or analysis afterwards. Because of the simplicity and general availability of the torque-drag model, it has been used extensively for planning and in the field. Field experience indicates that this model generally gives good results for many wells, but sometimes performs poorly.

In the standard torque-drag model, the drillstring trajectory is assumed to be the same as the wellbore trajectory, which is a reasonable assumption considering that surveys are taken within the drillstring. Contact with the wellbore is assumed to be continuous. However, given that the most common method for determining the wellbore trajectory is the minimum curvature method, the wellbore shape is less than ideal because the bending moment is not continuous and smooth at survey points. This problem is dealt with by neglecting bending moment but, as a result of this assumption, some of the contact force is also neglected.

Therefore, there is a need for a new wellbore trajectory model that has sufficient smoothness to model the drillstring trajectory.

There is a further need to provide a new wellbore trajectory model that transforms the simple torque-drag drill string model into a full stiff-string formulation because, in this formulation, drill string bending and shear forces arise that cannot be determined correctly with conventional wellbore trajectory models.

SUMMARY OF THE INVENTION

The present invention meets the above needs and overcomes one or more deficiencies in the prior art by providing systems and methods for modeling a wellbore trajectory, which can be used to model the corresponding drillstring trajectory and transform the torque-drag drill string model into a full stiff-string formulation.

In one embodiment, the present invention includes a computer implemented method for modeling a wellbore trajectory, which comprises: i) calculating a tangent vector interpolation function for each interval between two or more survey points within a wellbore using a wellbore curvature, a tangent vector and a normal vector at each respective survey point; and (ii) determining the wellbore trajectory using a computer processor and each tangent vector interpolation function in a torque-drag drillstring model.

In another embodiment, the present invention includes a non-transitory computer readable medium having computer executable instructions for modeling a wellbore trajectory. The instructions are executable to implement: i) calculating a tangent vector interpolation function for each interval between two or more survey points within a wellbore using a wellbore curvature, a tangent vector and a normal vector at each respective survey point; and (ii) determining the wellbore trajectory using each tangent vector interpolation function in a torque-drag drillstring model.

In yet another embodiment, the present invention includes a computer implemented method for modeling a wellbore trajectory, which comprises: i) calculating a tangent vector at each survey point within a wellbore using survey data at each respective survey point, the wellbore comprising two or more survey points; ii) calculating a special normal vector and a special binormal vector at each survey point; iii) calculating a block tridiagonal matrix using the tangent vector, the special normal vector, and the special binormal vector at each respective survey point; iv) calculating a coefficient at each survey point in the direction of the special normal vector at the respective survey point and another coefficient at each survey point in the direction of the special binormal vector at the respective survey point using the block tridiagonal matrix; v) calculating a wellbore curvature at each survey point and a normal vector at each survey point using a first derivative of the tangent vector, the coefficient and the another coefficient at each respective survey point; vi) calculating a tangent vector interpolation function for each interval between the survey points using the wellbore curvature, the tangent vector and the normal vector at each respective survey point; and vii) determining the wellbore trajectory using a computer processor and each tangent vector interpolation function in a torque-drag drillstring model.

In yet another embodiment, the present invention includes a non-transitory computer readable medium having computer executable instructions for modeling a wellbore trajectory. The instructions are executable to implement: i) calculating a tangent vector at each survey point within a wellbore using survey data at each respective survey point, the wellbore comprising two or more survey points; ii) calculating a special normal vector and a special binormal vector at each survey point; iii) calculating a block tridiagonal matrix using the tangent vector, the special normal vector, and the special binormal vector at each respective survey point; iv) calculating a coefficient at each survey point in the direction of the special normal vector at the respective survey point and another coefficient at each survey point in the direction of the special binormal vector at the respective survey point using the block tridiagonal matrix; v) calculating a wellbore curvature at each survey point and a normal vector at each survey point using a first derivative of the tangent vector, the coefficient and the another coefficient at each respective survey point; vi) calculating a tangent vector interpolation function for each interval between the survey points using the wellbore curvature, the tangent vector and the normal vector at each respective survey point; and vii) determining the wellbore trajectory using each tangent vector interpolation function in a torque-drag drillstring model.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order.

System Description

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. WELLPLAN™, which is a commercial software application marketed by Landmark Graphics Corporation, may be used as an interface application to implement the present invention. The software may also cooperate with other code segments to initiate a variety of tasks in response to data received in conjunction with the source of the received data. The software may be stored and/or carried on any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire, free space and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof, in a computer system or other processing system.

Figure 1:
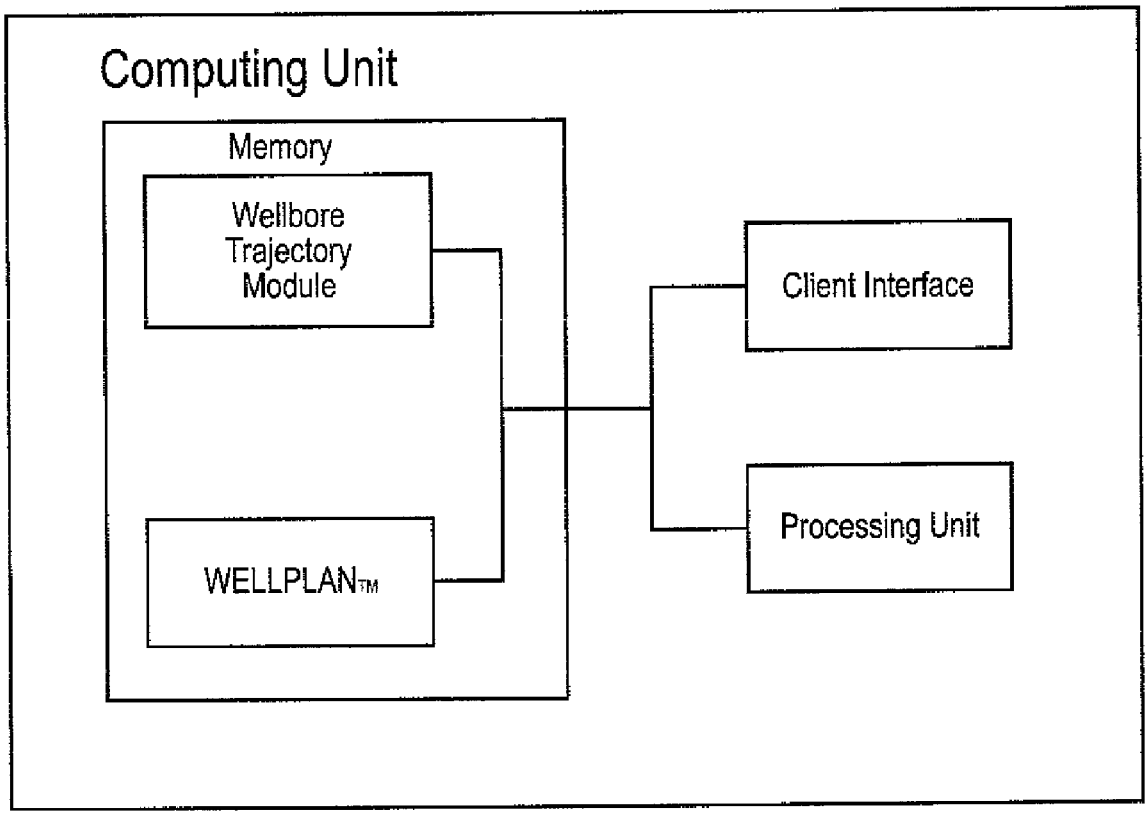
FIG. 1 is a block diagram illustrating one embodiment of a system for implementing the present invention.

Referring now to FIG. 1, a block diagram of a system for implementing the present invention on a computer is illustrated. The system includes a computing unit, sometimes referred to as a computing system, which contains memory, application programs, a client interface, and a processing unit. The computing unit is only one example of a suitable computing environment and is not intended to suggest any limitation as to the scope of use or functionality of the invention.

The memory primarily stores the application programs, which may also be described as program modules containing computer-executable instructions, executed by the computing unit for implementing the methods described herein and illustrated in FIGS. 2-12. The memory therefore, includes a Wellbore Trajectory Module, which enables the methods illustrated and described in reference to FIGS. 2-12, and WELLPLAN™.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to, and/or presently being operated on by, the processing unit. By way of example, and not limitation, the computing unit includes an operating system, application programs, other program modules, and program data.

The components shown in the memory may also be included in other removable/nonremovable, volatile/nonvolatile computer storage media. For example only, a hard disk drive may read from or write to nonremovable, nonvolatile magnetic media, a magnetic disk drive may read from or write to a removable, non-volatile magnetic disk, and an optical disk drive may read from or write to a removable, nonvolatile optical disk such as a CD ROM or other optical media. Other removable/non-removable, volatile/non-volatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above therefore, store and/or carry computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like.

These and other input devices are often connected to the processing unit through the client interface that is coupled to a system bus, but may be connected by other interface and bus structures, such as a parallel port or a universal serial bus (USB). A monitor or other type of display device may be connected to the system bus via an interface, such as a video interface. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

Method Description

Unlike prior wellbore trajectory models, the present invention proceeds from the concept that the trajectory given by the survey measurements made within the drillstring is the trajectory of the drillstring, which must have continuity of bending moment proportional to curvature. The nomenclature used herein is described in the Society of Petroleum Engineers article "Drillstring Solutions Improve the Torque-Drag Model" by Mitchell, Robert F. ("SPE 112623"), which is incorporated herein by reference and repeated in Table 1 below.

TABLE 1

| | |
|---|---|
| $\vec{b}$ | binormal vector |
| $\tilde{b}$ | special binormal vector |
| E | Young's elastic modulus (psf) |
| F | the effective axial force (lbf.) |
| $\tilde{F}$ | $F - EI\kappa^2$ |
| I | moment of inertia ($ft^4$) |
| $\vec{1}_E$ | unit vector in east direction |
| $\vec{1}_N$ | unit vector in north direction |
| $\vec{1}_Z$ | unit vector in downward direction |
| $\vec{n}$ | normal vector |
| $\tilde{n}$ | special normal vector |
| s | measured depth (ft) |
| $\vec{t}$ | tangent vector |
| $\vec{T}$ | spline tangent vector function |
| $\vec{u}$ | position vector, (ft) |
| $\vec{u}_j^0$ | initial position vector, increment j (ft) |
| $\alpha_j$ | coefficient in $\tilde{n}$ direction ($ft^{-1}$) |
| $\beta_j$ | coefficient in $\tilde{b}$ direction ($ft^{-1}$) |
| $\Delta s_j$ | $s_{j+1} - s_j$ (ft) |
| $\lambda_j$ | Coefficient in spline functions |
| $\epsilon_j$ | angle between $\vec{n}$ and $\tilde{n}$ |
| $\kappa$ | wellbore curvature ($ft^{-1}$) |
| $\phi$ | wellbore trajectory inclination angle |
| $\Theta$ | wellbore trajectory azimuth angle |
| $\xi_j$ | $(s - s_j)/(s_{j+1} - s_j)$ |
| ' | d/ds |
| $IV$ | $d^4/ds^4$ |
| subscripts | |
| j | survey point |

The use of cubic splines is well known in the art for achieving higher continuity in a trajectory model. If, for example, a table of $\{x_i, y_i\}$ is used, intermediate values of y as a function of x may be determined by linear interpolation:

$$y(x) = y_j\left(\frac{x_{j+1} - x}{x_{j+1} - x_j}\right) + y_{j+1}\left(\frac{x - x_j}{x_{j+1} - x_j}\right) \tag{1}$$

where the interpolation occurs between $x_j$ and $x_{j+1}$. If it is desired that the interpolation have smooth first and second derivatives at the $x_j$ points, the interpolation may be:

$$y(x)=y_j f_1(x)+y''_j f_2(x)+y_{j+1} f_3(x)+y''_{j+1} f_4(x) \tag{2}$$

where the functions $f_j$ are devised so that:

$$y(x_j)=y_j \tag{3}$$

$$y(x_{j-1})=y_{j+1}$$

$$y''(x_j)=y''_j$$

$$y''(x_{j+1})=y''_{j+1}$$

In the classic cubic spline formulation, the $f_j$ are cubic functions of x and the unknown coefficients $y''_j$ are determined by requiring continuity of the first derivatives of y(x) at each $x_j$. Here the functions in equation (2) need not be cubic functions. They must only satisfy equations (3). The use of spline formulations such as, for example, cubic splines and tangent splines to model wellbore trajectories is well known in the art. The determination of the wellbore trajectory from survey data, however, is not. Furthermore, the use of conventional splines, as applied to a three-dimensional curve, will not satisfy equation (5) and equation (6).

Once survey data is obtained, the tangent vector $\vec{t}_j$ at each survey point j can be calculated. One formula for interpolating the tangent vectors is:

$$\vec{t}_j(s) = \frac{\vec{T}_j(s)}{\sqrt{\vec{T}_j(s)\cdot\vec{T}_j(s)}} \tag{4}$$

$$T_j(s) = \vec{t}_j f_{1j}(s) + \kappa_j \vec{n}_j f_{2j}(s) + \vec{t}_{j+1} f_{3j}(s) + \kappa_{j+1}\vec{n}_{j+1} f_{4j}(s)$$

where s is measured depth, $\kappa_j$ is the curvature at $s_j$, and $\vec{n}_j$ is the normal vector at $s_j$. This formulation has two purposes. The first purpose is to satisfy the Frenet equation for a curve (by suitable choice of functions $f_{ij}$):

$$\frac{d\vec{t}(s)}{ds} = \kappa(s)\vec{n}(s) \tag{5}$$

The second reason is to insure that s is indeed measured depth. This requirement means:

$$du_1^2+du_2^2+du_3^2=ds^2$$

(an incremental change of position equals the incremental arc length) or, in terms of the tangent vectors:

$$\left(\frac{du_1}{ds}\right)^2+\left(\frac{du_2}{ds}\right)^2+\left(\frac{du_3}{ds}\right)^2 = \frac{d\vec{u}}{ds}\cdot\frac{d\vec{u}}{ds} = \vec{t}\cdot\vec{t} = 1 \tag{6}$$

As demonstrated in the following section, equation (4) satisfies this condition. The details for determining the unknowns in equation (4), which are the normal vectors and the curvatures, are also addressed in the following section.

Spline Wellbore Trajectory

The normal method for determining the well path is to use some type of surveying instrument to measure the inclination and azimuth at various depths and then to calculate the trajectory. At each survey point j, inclination angle $\phi_j$ and azimuth angle $\theta_j$ are measured, as well as the course length $\Delta s_j = s_{j+1} - s_j$ between survey points. Each survey point j therefore, includes survey data comprising an inclination angle $\phi_j$, an azimuth angle $\theta_j$ and a measured depth s. These angles have been corrected (i) to true north for a magnetic survey or (ii) for drift if a gyroscopic survey. The survey angles define the tangent $\vec{t}_j$ to the trajectory at each survey point j where the tangent vector is defined in terms of inclination $\phi_j$ and azimuth $\theta_j$ in the following formulas:

$$\vec{t}_j\cdot\vec{t}_N = \cos(\theta_j)\sin(\phi_j) \tag{7}$$

$$\vec{t}_j\cdot\vec{t}_E = \sin(\theta_j)\sin(\phi_j)$$

$$\vec{t}_j\cdot\vec{t}_z = \cos(\phi_j)$$

If it was known how the angles $\phi$ and $\theta$ varied between survey points, or equivalently, if it was known how the tangent vectors varied between survey points, then the trajectory could be determined by integrating the tangent vector:

$$\vec{t}_j = \frac{d\vec{u}_j}{ds}, \text{ so} \tag{8}$$

$$\vec{u}_j(s) = \vec{u}_j^{\,o} + \int_j \vec{t}_j\, ds$$

Given tangent vectors $\vec{t}_j$ and $\vec{t}_{j+1}$ and associated normal vectors $\vec{n}_j$ and $\vec{n}_{j+1}$, a tangent vector interpolation function connecting these vectors can be created. First, a set of interpolation functions $f_{ij}(s)$, s in $[s_j, s_{j+1}]$, with the following properties, will be needed:

$$f_{1j}(s_j) = 1,\ \frac{df_{1j}(s_j)}{ds} = 0,\quad f_{1j}(s_{j+1}) = 0,\ \frac{df_{1j}(s_{j+1})}{ds} = 0 \tag{9}$$

$$f_{2j}(s_j) = 0,\ \frac{df_{2j}(s_j)}{ds} = 1,\quad f_{2j}(s_{j+1}) = 0,\ \frac{df_{2j}(s_{j+1})}{ds} = 0$$

$$f_{3j}(s_j) = 0,\ \frac{df_{3j}(s_j)}{ds} = 0,\quad f_{3j}(s_{j+1}) = 1,\ \frac{df_{3j}(s_{j+1})}{ds} = 0$$

$$f_{4j}(s_j) = 0,\ \frac{df_{4j}(s_j)}{ds} = 0,\quad f_{4j}(s_{j+1}) = 0,\ \frac{df_{4j}(s_{j+1})}{ds} = 1$$

There are a variety of functions that satisfy equations (9). If the spline function $T_j(\xi)$ is defined as:

$$T_j(\xi) = \vec{t}_j f_{1j}(s) + \kappa_j \vec{n}_j f_{2j}(s) + \vec{t}_{j+1} f_{3j}(s) + \kappa_{j+1}\vec{n}_{j+1} f_{4j}(s) \tag{10}$$

it becomes clear that:

$$\vec{T}_j(s_j) = \vec{t}_j \tag{11}$$

$$\vec{T}_j(s_{j+1}) = \vec{t}_{j+1}$$

$$\frac{d\vec{T}_j}{ds}(s_j) = \kappa_j\vec{n}_j$$

$$\frac{d\vec{T}_j}{ds}(s_{j+1}) = \kappa_{j+1}\vec{n}_{j+1}$$

The function $T_j$ satisfies the Frenet equation:

$$\frac{d\vec{t}(s)}{ds} = \kappa(s)\vec{n}(s) \tag{12}$$

for a tangent vector at $s=s_j$ and $s_{j+1}$. However, $T_j$ is not a tangent vector because it is not a unit vector. This can be corrected by normalizing Tj:

$$\vec{t}_j(s) = \frac{\vec{T}_j(s)}{\sqrt{\vec{T}_j(s)\cdot\vec{T}_j(s)}} \tag{13}$$

where it is shown that equation (12) is still satisfied. In order to evaluate the curvatures $\kappa_j$, equation (13) is differentiated twice and evaluated at $s=s_j$ and $s_{j+1}$:

$$\frac{d^2\vec{t}(s_j)}{ds^2}\cdot\vec{t}_j=-\kappa_j^2 \tag{14}$$

$$\frac{d^2\vec{t}(s_j)}{ds^2}\cdot\vec{n}_j=$$

$$\kappa_j\frac{d^2 f_{2j}(s_j)}{ds^2}+\vec{n}_j\cdot\vec{t}_{j+1}\frac{d^2 f_{3j}(s_j)}{ds^2}+\kappa_{j+1}n_{j+1}\cdot\vec{n}_j\frac{d^2 f_{4j}(s_j)}{ds^2}$$

$$\frac{d^2\vec{t}(s_j)}{ds^2}\cdot\vec{b}_j=\vec{t}_{j+1}\cdot\vec{b}_j\frac{d^2 f_{3j}(s_j)}{ds^2}+\kappa_{j+1}\vec{n}_{j+1}\cdot\vec{b}_j\frac{d^2 f_{4j}(s_j)}{ds^2}$$

$$\frac{d^2\vec{t}(s_{j+1})}{ds^2}\cdot\vec{t}_{j+1}=-\kappa_{j+1}^2$$

$$\frac{d^2\vec{t}(s_{j+1})}{ds^2}\cdot\vec{n}_{j+1}=$$

$$\kappa_{j+1}\frac{d^2 f_{4j}(s_{j+1})}{ds^2}+\vec{n}_{j+1}\cdot\vec{t}_j\frac{d^2 f_{1j}(s_{j+1})}{ds^2}+\kappa_j\vec{n}_j\cdot n_{j+1}\frac{d^2 f_{2j}(s_{j+1})}{ds^2}$$

$$\frac{d^2\vec{t}(s_{j+1})}{ds^2}\cdot\vec{b}_{j+1}=\vec{t}_j\cdot\vec{b}_{j+1}\frac{d^2 f_{1j}(s_{j+1})}{ds^2}+\kappa_j\vec{n}_j\cdot\vec{b}_{j+1}\frac{d^2 f_{2j}(s_{j+1})}{ds^2}$$

Using the Frenet equation (12) and $$\frac{d\vec{n}(s)}{ds}=-\kappa(s)\vec{t}(s)+\tau(s)\vec{b}(s) \tag{15}$$

$$\frac{d^2\vec{t}(s)}{ds^2}=-\kappa^2(s)\vec{t}(s)+\kappa'(s)\vec{n}(s)+\kappa(s)\tau(s)\vec{b}(s)$$

it is evident that:

$$\frac{d^2\vec{t}(s_j)}{ds^2}\cdot\vec{t}_j=-\kappa_j^2 \tag{16a}$$

$$\frac{d^2\vec{t}(s_j)}{ds^2}\cdot\vec{n}_j=\frac{d\kappa_j}{ds} \tag{16b}$$

$$\frac{d^2\vec{t}(s_j)}{ds^2}\cdot\vec{b}_j=\kappa_j\tau_j \tag{16c}$$

$$\frac{d^2\vec{t}(s_{j+1})}{ds^2}\cdot\vec{t}_{j+1}=-\kappa_{j+1}^2 \tag{16d}$$

$$\frac{d^2\vec{t}(s_{j+1})}{ds^2}\cdot\vec{n}_{j+1}=\frac{d\kappa_{j+1}}{ds} \tag{16e}$$

$$\frac{d^2\vec{t}(s_{j+1})}{ds^2}\cdot\vec{b}_{j+1}=\kappa_{j+1}\tau_{j+1} \tag{16f}$$

The Frenet formulae, equation (15), are identically satisfied by equation (16a) and equation (16d). Before this set of equations can be solved for curvatures $\kappa_j$, a representation for the normal vector $(\vec{n}_j)$ and the binormal vector $(\vec{b}_j)$ is needed. The tangent vector is defined by the inclination angle $(\phi_j)$ and the azimuth angle $(\theta_j)$ in the following way:

$$\vec{t}_j=\begin{bmatrix}\sin\varphi_j\cos\vartheta_j\\ \sin\varphi_j\sin\vartheta_j\\ \cos\varphi_j\end{bmatrix} \tag{17}$$

Then the Frenet equation (7) requires:

$$\frac{d}{ds}\vec{t}_j=\begin{bmatrix}\cos\varphi_j\cos\vartheta_j\\ \cos\varphi_j\sin\vartheta_j\\ -\sin\varphi_j\end{bmatrix}\frac{d}{ds}\varphi_j+\begin{bmatrix}-\sin\vartheta_j\\ \cos\vartheta_j\\ 0\end{bmatrix}\sin\varphi_j\frac{d}{ds}\vartheta_j=\kappa_j\vec{n}_j \tag{18}$$

From equation (12), the equation for the curvature $\kappa_j$ becomes:

$$\kappa_j=\sqrt{\left(\frac{d}{ds}\varphi_j\right)^2+\sin^2\varphi_j\left(\frac{d}{ds}\vartheta_j\right)^2} \tag{19}$$

We define the following quantities found in equation (18):

$$\tilde{n}_j=\begin{bmatrix}\cos\varphi_j\cos\vartheta_j\\ \cos\varphi_j\sin\vartheta_j\\ -\sin\varphi_j\end{bmatrix} \tag{20}$$

$$\tilde{b}_j=\begin{bmatrix}-\sin\vartheta_j\\ \cos\vartheta_j\\ 0\end{bmatrix}$$

These vectors are useful in defining the normal and binormal vectors.

As provided above, $\vec{t}_j$, $\tilde{n}_j$, and $\tilde{b}_j$ form a right-handed coordinate system at $s_j$. The normal vector $(\vec{n}_j)$ and the binormal vector $(\vec{b}_j)$ can be defined by rotation through the angle $\epsilon_j$ around the tangent vector:

$$\vec{n}_j=\tilde{n}_j\cos\epsilon_j+\tilde{b}_j\sin\epsilon_j \tag{21}$$

$$\vec{b}_j=-\tilde{n}_j\sin\epsilon_j+\tilde{b}_j\cos\epsilon_j$$

Then $\vec{n}_j$ is a unit vector consistent with Frenet equation (5), given:

$$\cos\varepsilon_j=\frac{1}{\kappa_j}\frac{d}{ds}\varphi_j \text{ and } \sin\varepsilon_j=\frac{\sin\varphi_j}{\kappa_j}\frac{d}{ds}\vartheta_j \tag{22}$$

The variables $\kappa_j$ and $\epsilon_j$ are not the most convenient choices because of the nonlinearity introduced by the sine and cosine functions. An alternate selection may be:

$$\kappa_j\vec{n}_j=\alpha_j\tilde{n}_j+\beta_j\tilde{b}_j \tag{23}$$

$$\alpha_j=\kappa_j\cos\varepsilon_j$$

$$\beta_j=\kappa_j\sin\varepsilon_j$$

$$\kappa_j=\sqrt{\alpha_j^2+\beta_j^2}$$

$$\varepsilon_j=\tan^{-1}\frac{\beta_j}{\alpha_j}$$

Equations (16a)-(16f) can be rewritten in terms of the vectors $\tilde{n}$ and $\tilde{b}$ to give:

$$\frac{d^2\vec{t}(s_j)}{ds^2}\cdot\tilde{n}_j=\alpha_j\frac{d^2 f_{2j}(s_j)}{ds^2}+\tilde{n}_j\cdot\vec{t}_{j+1}\frac{d^2 f_{3j}(s_j)}{ds^2}+\tilde{n}_j\cdot\left[\alpha_{j+1}\tilde{n}_{j+1}+\beta_{j+1}\tilde{b}_{j+1}\right]\frac{d^2 f_{4j}(s_j)}{ds^2} \tag{24}$$

$$\frac{d^2\vec{t}(s_j)}{ds^2}\cdot\tilde{b}_j=\beta_j\frac{d^2 f_{2j}(s_j)}{ds^2}+\tilde{b}_j\cdot\vec{t}_{j+1}\frac{d^2 f_{3j}(s_j)}{ds^2}+\tilde{b}_j\cdot\left[\alpha_{j+1}\tilde{n}_{j+1}+\beta_{j+1}\tilde{b}_{j+1}\right]\frac{d^2 f_{4j}(s_j)}{ds^2}$$

$$\frac{d^2\vec{t}(s_{j+1})}{ds^2}\cdot\tilde{n}_{j+1}=\alpha_{j+1}\frac{d^2 f_{4j}(s_{j+1})}{ds^2}+\tilde{n}_{j+1}\cdot\vec{t}\frac{d^2 f_{1j}(s_{j+1})}{ds^2}+\tilde{n}_{j+1}\cdot\left[\alpha_j\tilde{n}_j+\beta_j\tilde{b}_j\right]\frac{d^2 f_{2j}(s_{j+1})}{ds^2}$$

$$\frac{d^2\vec{t}(s_{j+1})}{ds^2}\cdot\tilde{b}_{j+1}=\beta_{j+1}\frac{d^2 f_{4j}(s_{j+1})}{ds^2}+\tilde{b}_{j+1}\cdot\vec{t}_j\frac{d^2 f_{1j}(s_{j+1})}{ds^2}+\tilde{b}_{j+1}\cdot\left[\alpha_j\tilde{n}_j+\beta_j\tilde{b}_j\right]\frac{d^2 f_{2j}(s_{j+1})}{ds^2}$$

Continuity of $d^2\vec{t}/ds^2$ at survey points requires for j=2, N−1:

$$\left[\alpha_{j-1}\tilde{n}_j\cdot\tilde{n}_{j-1}+\beta_{j-1}\tilde{n}_j\cdot\tilde{b}_{j-1}\right]\frac{d^2 f_{2j-1}}{ds^2}+\alpha_j\left(\frac{d^2 f_{2j}}{ds^2}+\frac{d^2 f_{4j-1}}{ds^2}\right)+\left[\alpha_{j+1}\tilde{n}_j\cdot\tilde{n}_{j+1}+\beta_{j+1}\tilde{n}_j\cdot\tilde{b}_{j+1}\right]\frac{d^2 f_{4j}}{ds^2}=\tilde{n}_j\cdot\left(\vec{t}_{j+1}\frac{d^2 f_{3j}}{ds^2}-\vec{t}_{j-1}\frac{d^2 f_{1j-1}}{ds^2}\right) \tag{25}$$

$$\left[\alpha_{j-1}\tilde{b}_j\cdot\tilde{n}_{j-1}+\beta_{j-1}\tilde{b}_j\cdot\tilde{b}_{j-1}\right]\frac{d^2 f_{2j-1}}{ds^2}+\beta_j\left(\frac{d^2 f_{2j}}{ds^2}+\frac{d^2 f_{4j-1}}{ds^2}\right)+\left[\alpha_{j+1}\tilde{b}_j\cdot\tilde{n}_{j+1}+\beta_{j+1}\tilde{b}_j\cdot\tilde{b}_{j+1}\right]\frac{d^2 f_{4j}}{ds^2}=\tilde{b}_j\cdot\left(\vec{t}_{j+1}\frac{d^2 f_{3j}}{ds^2}-\vec{t}_{j-1}\frac{d^2 f_{1j-1}}{ds^2}\right)$$

The set of equations (25) together with boundary conditions defined at the initial and end points form a diagonally dominant block tridiagonal set of equations that are relatively easy to solve. Notably, by also solving for $\alpha_j$ and $\beta_j$, the system has also solved for $d\phi_j/ds$ and $d\theta_j/ds$ through equation (23). Further, there is no ambiguity about the magnitude of $\theta_j(\pm n\pi)$ in the definition of these derivatives.

There is therefore, a need for expressions for the parameters κ, τ, and κ' that appear in the torque-drag equilibrium equations.

Recalling the Frenet formulae (equations (12) and (15)):

$$\frac{d\vec{t}(s)}{ds}=\kappa(s)\vec{n}(s) \tag{26}$$

$$\frac{d\vec{n}(s)}{ds}=-\kappa(s)\vec{t}(s)+\tau(s)\vec{b}(s)$$

$$\frac{d^2\vec{t}(s)}{ds^2}=-\kappa^2(s)\vec{t}(s)+\kappa'(s)\vec{n}(s)+\kappa(s)\tau(s)\vec{b}(s)$$

$$\vec{t}(s)\times\frac{d\vec{t}(s)}{ds}=\vec{t}(s)\times\kappa(s)\vec{n}(s)=\kappa(s)\vec{b}(s)$$

it is determined that:

$$\kappa(s)=\sqrt{\frac{d}{ds}\vec{t}_j(s)\cdot\frac{d}{ds}\vec{t}_j(s)} \tag{27}$$

$$\kappa(s)\frac{d}{ds}\kappa(s)=\frac{d}{ds}\vec{t}_j(s)\cdot\frac{d^2}{ds^2}\vec{t}_j(s)$$

$$\kappa(s)^2\tau(s)=\frac{d^2}{ds^2}\vec{t}_j(s)\cdot\left[\vec{t}_j(s)\times\frac{d}{ds}\vec{t}_j(\xi)\right]$$

If κ is non-zero at a given point, then:

$$\kappa(s)=\sqrt{\frac{d}{ds}\vec{t}_j(s)\cdot\frac{d}{ds}\vec{t}_j(s)} \tag{28}$$

$$\frac{d}{ds}\kappa(s)=\frac{\frac{d}{ds}\vec{t}_j(s)\cdot\frac{d^2}{ds^2}\vec{t}_j(s)}{\sqrt{\frac{d}{ds}\vec{t}_j(s)\cdot\frac{d}{ds}\vec{t}_j(s)}}$$

$$\tau(s)=\frac{\frac{d^2}{ds^2}\vec{t}_j(s)\cdot\left[\vec{t}_j(s)\times\frac{d}{ds}\vec{t}_j(s)\right]}{\frac{d^2}{ds}\vec{t}_j(s)\cdot\frac{d}{ds}\vec{t}_j(s)}$$

Since the system is intended to model drillstrings, the best choice for interpolating functions ($f_{ij}$) are solutions to actual drillstring problems. The equation for the mechanical equilibrium of a weightless elastic rod with large displacement is:

$$EI\vec{u}^{iv}-[(F-EI\kappa^2)\vec{u}']'=\vec{0} \tag{29}$$

where EI is the bending stiffness, F is the axial force (tension positive), and κ is the curvature of the rod. Looking at a small interval of s, F and κ are roughly constant, so the solution to equation (7) becomes:

$$u(s)=c_0+c_1s+c_2\sin h(\lambda s)+c_3\cos h(\lambda s) \tag{30a}$$

when: $EI\lambda^2=F-EI\kappa^2>0$ $$u(s)=c_0+c_1s+c_2\sin(\lambda s)+c_3\cos(\lambda s) \tag{30b}$$

when: $EI\lambda^2=EI\kappa^2-F>0$ $$u(s)=c_0+c_1s+c_2s^2+c_3s^3 \tag{30c}$$

when: $EI\kappa^2-F=0$ where the $c_0$-$c_3$ are four constants to be determined. The third equation is a cubic equation, so cubic splines are a candidate solution, even though they represent a special case of zero axial loads. Equation (30a) can be used to define what are known as tension-splines and equation (30b) may be used to define "compression" splines. This is demonstrated in the following section using drillstring solutions as interpolation functions.

Drillstring Solutions as Interpolation Functions

As demonstrated in the Spline Wellbore Trajectory section above, a set of interpolation functions $f_{ij}(s)$, s in $[s_j, s_{j+1}]$, is needed with the following properties:

$$f_{1j}(s_j)=1,\quad \frac{d f_{1j}(s_j)}{ds}=0,\quad f_{1j}(s_{j+1})=0,\quad \frac{d f_{1j}(s_{j+1})}{ds}=0 \tag{31}$$
$$f_{2j}(s_j)=0,\quad \frac{d f_{2j}(s_j)}{ds}=1,\quad f_{2j}(s_{j+1})=0,\quad \frac{d f_{2j}(s_{j+1})}{ds}=0$$
$$f_{3j}(s_j)=0,\quad \frac{d f_{3j}(s_j)}{ds}=0,\quad f_{3j}(s_{j+1})=1,\quad \frac{d f_{3j}(s_{j+1})}{ds}=0$$
$$f_{4j}(s_j)=0,\quad \frac{d f_{4j}(s_j)}{ds}=0,\quad f_{4j}(s_{j+1})=0,\quad \frac{d f_{4j}(s_{j+1})}{ds}=1$$

For example, the following cubic functions satisfy the requirements of equation (31):

$$\begin{aligned} f_{1j}(s)&=1+(2\xi-3)\xi^2 \\ f_{2j}(s)&=\xi(\xi-1)^2(s_{j+1}-s_j) \\ f_{3j}(s)&=(3-2\xi)\xi^2 \\ f_{4j}(s)&=\xi^2(\xi-1)(s_{j+1}-s_j) \\ \xi&=\frac{s-s_j}{s_{j+1}-s_j} \end{aligned} \tag{32}$$

The cubic spline functions defined in equation (32) are not the only possible choices. An alternate formulation that has direct connection to drillstring solutions is the tension spline:

$$\begin{aligned} f_{1j}(\xi)&=1+\frac{[\cosh(\lambda)-1)][1-\cosh(\lambda\xi)]}{\lambda\sinh(\lambda)+2[1-\cosh(\lambda)]}-\frac{\sinh(\lambda)[\lambda\xi-\sinh(\lambda\xi)]}{\lambda\sinh(\lambda)+2[1-\cosh(\lambda)]} \\ f_{2j}(\xi)&=\left\{\xi-\frac{[\sinh(\lambda)-\lambda\cosh(\lambda))][1-\cosh(\lambda\xi)]}{\lambda^2\sinh(\lambda)+2\lambda[1-\cosh(\lambda)]}-\frac{[\lambda\sinh(\lambda)+1-\cosh(\lambda)][\lambda\xi-\sinh(\lambda\xi)]}{\lambda^2\sinh(\lambda)+2\lambda[1-\cosh(\lambda)]}\right\}(s_{j+1}-s_j) \\ f_{3j}(\xi)&=\frac{[1-\cosh(\lambda))][1-\cosh(\lambda\xi)]}{\lambda\sinh(\lambda)+2[1-\cosh(\lambda)]}+\frac{\sinh(\lambda)[\lambda\xi-\sinh(\lambda\xi)]}{\lambda\sinh(\lambda)+2[1-\cosh(\lambda)]} \\ f_{4j}(\xi)&=\left\{\frac{[\sinh(\lambda)-\lambda)][1-\cosh(\lambda\xi)]}{\lambda^2\sinh(\lambda)+2\lambda[1-\cosh(\lambda)]}+\frac{[1-\cosh(\lambda)][\lambda\xi-\sinh(\lambda\xi)]}{\lambda^2\sinh(\lambda)+2\lambda[1-\cosh(\lambda)]}\right\}(s_{j+1}-s_j) \\ \xi&=\frac{s-s_j}{s_{j+1}-s_j} \end{aligned} \tag{33}$$

where λ is a parameter to be determined. For beam-column solutions, $$\begin{aligned} \lambda&=\Delta s\sqrt{\frac{\tilde{F}}{EI}} \\ \tilde{F}&=F-EI\kappa^2>0 \end{aligned} \tag{34}$$

A similar solution for strings in compression is:

$$\begin{aligned} f_{1j}(\xi)&=1-\frac{[\cos(\lambda)-1)][1-\cos(\lambda\xi)]}{\lambda\sin(\lambda)-2[1-\cos(\lambda)]}-\frac{\sin(\lambda)[\lambda\xi-\sin(\lambda\xi)]}{\lambda\sin(\lambda)-2[1-\cos(\lambda)]} \\ f_{2j}(\xi)&=\left\{\xi+\frac{[\sin(\lambda)-\lambda\cos(\lambda))][1-\cos(\lambda\xi)]}{\lambda^2\sin(\lambda)-2\lambda[1-\cos(\lambda)]}-\frac{[\lambda\sin(\lambda)-1+\cos(\lambda)][\lambda\xi-\sin(\lambda\xi)]}{\lambda^2\sin(\lambda)-2\lambda[1-\cos(\lambda)]}\right\}(s_{j+1}-s_j) \\ f_{3j}(\xi)&=\frac{[\cos(\lambda)-1)][1-\cos(\lambda\xi)]}{\lambda\sin(\lambda)-2[1-\cos(\lambda)]}+\frac{\sin(\lambda)[\lambda\xi-\sin(\lambda\xi)]}{\lambda\sin(\lambda)-2[1-\cos(\lambda)]} \\ f_{4j}(\xi)&=\left\{-\frac{[\sin(\lambda)-\lambda)][1-\cos(\lambda\xi)]}{\lambda^2\sin(\lambda)-2\lambda[1-\cos(\lambda)]}+\frac{\lambda[\cos(\lambda)-1][\lambda\xi-\sin(\lambda\xi)]}{\lambda^2\sin(\lambda)-2\lambda[1-\cos(\lambda)]}\right\}(s_{j+1}-s_j) \\ \xi&=\frac{s-s_j}{s_{j+1}-s_j} \end{aligned} \tag{35}$$

where λ is a parameter to be determined. For beam-column solutions, $$\begin{aligned} \lambda&=\Delta s\sqrt{\frac{-\tilde{F}}{EI}} \\ \tilde{F}&=F-EI\kappa^2<0 \end{aligned} \tag{36}$$

One problem is that the λ coefficients are functions of the axial force, which are not known until the torque-drag equations are solved. In practice, λ tends to be small, so that the solution approximates a cubic equation. The cubic interpolation can be used to approximate the trajectory, and to solve the torque-drag problem. The torque-drag solution can then be used to refine the trajectory, iterating if necessary.

Figure 2:
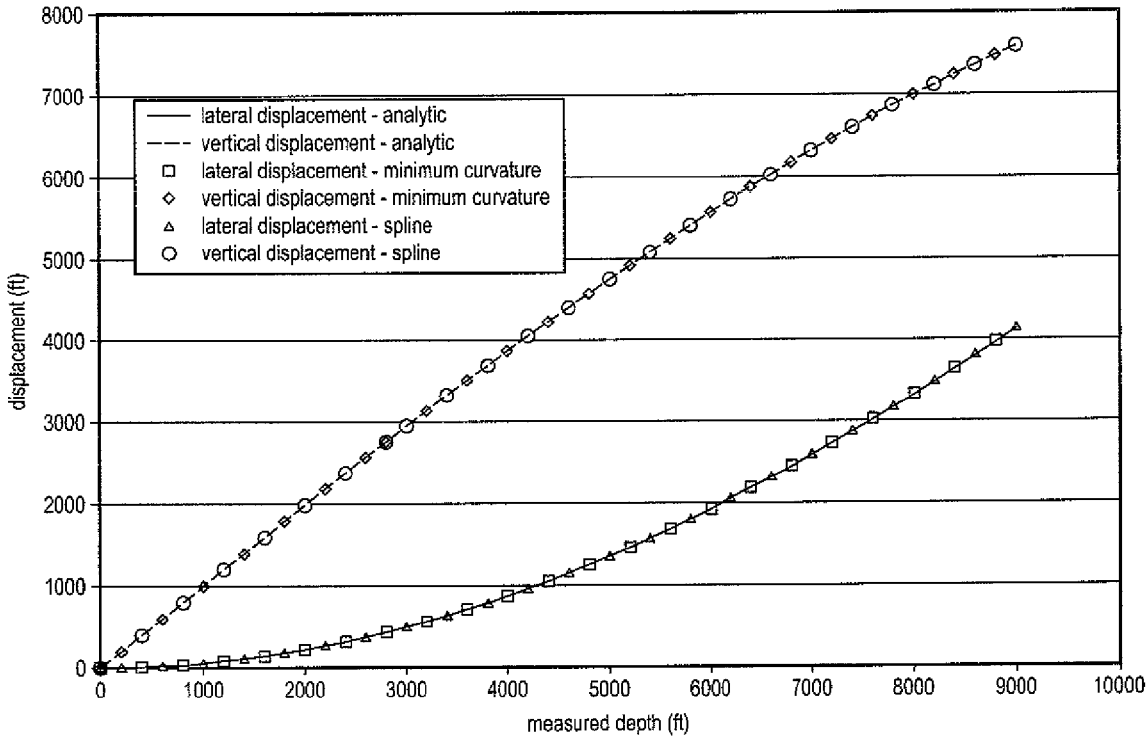
FIG. 2 is a graphical illustration comparing the analytic model, the minimum curvature model and the spline model of the present invention for a circular-arc wellbore trajectory.
Figure 3:
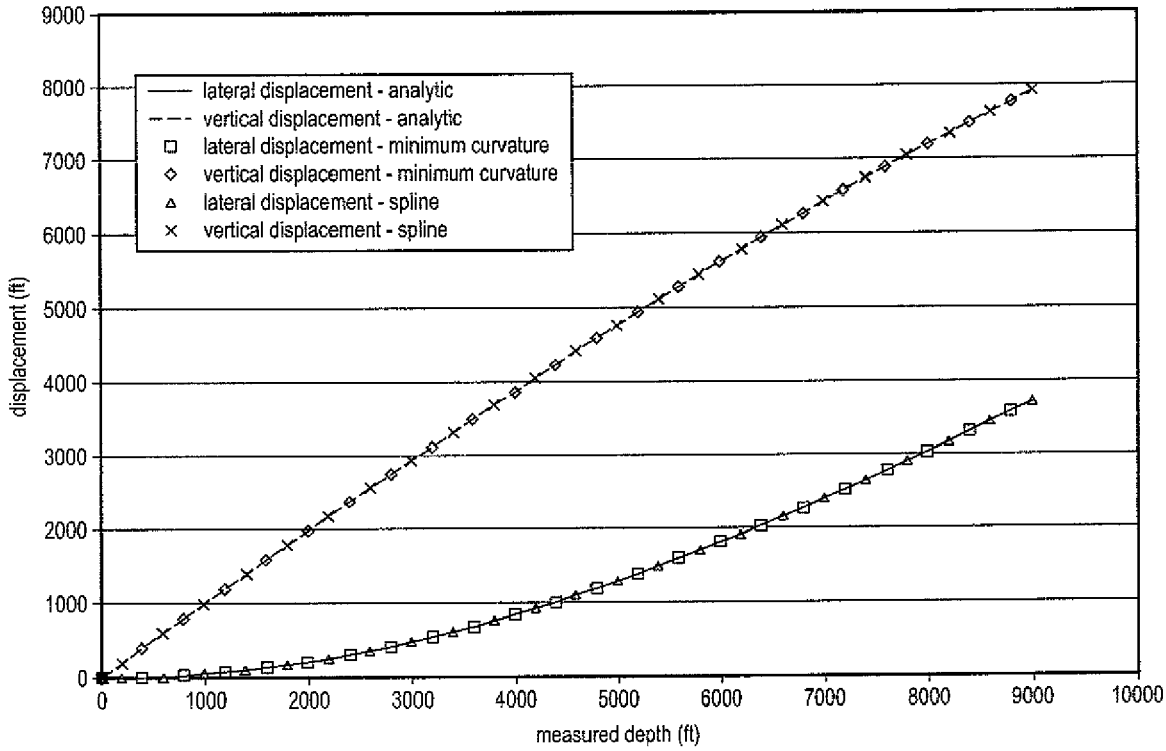
FIG. 3 is a graphical illustration comparing the analytic model, the minimum curvature model and the spline model of the present invention for a catenary wellbore trajectory.
Figure 4:
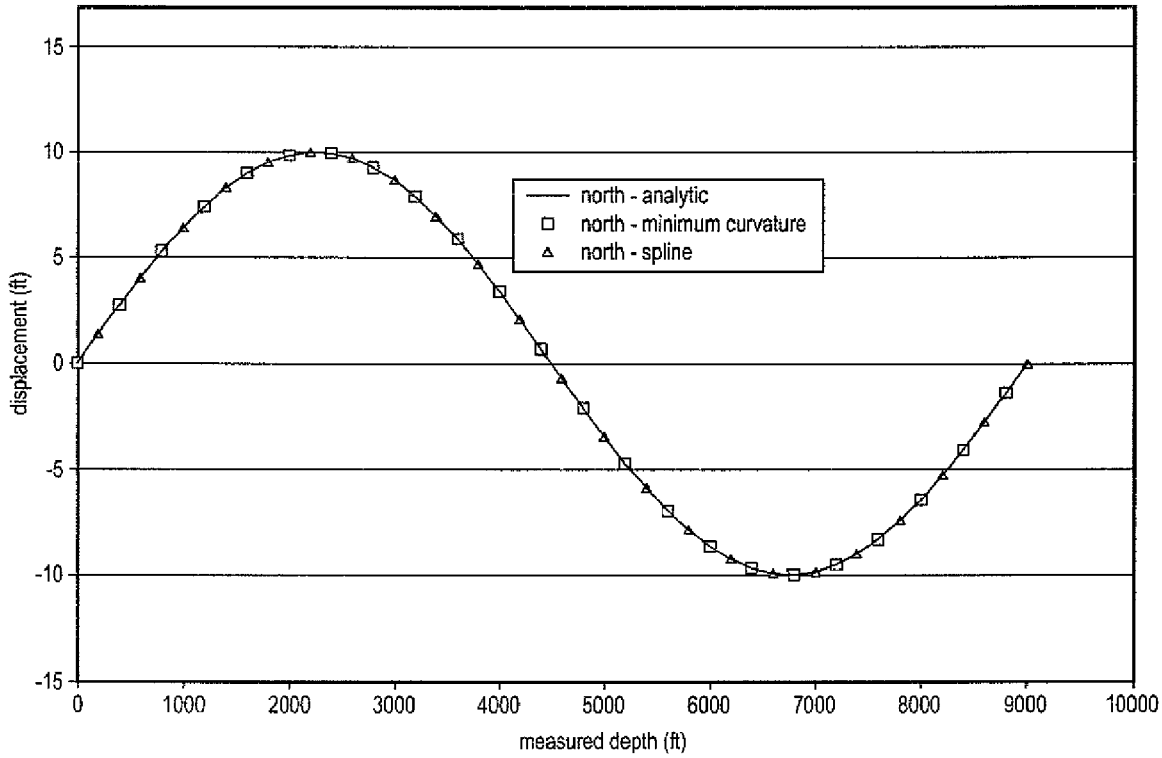
FIG. 4 is a graphical illustration comparing the analytic model, the minimum curvature model and the spline model of the present invention for a helix wellbore trajectory.
Figure 5:
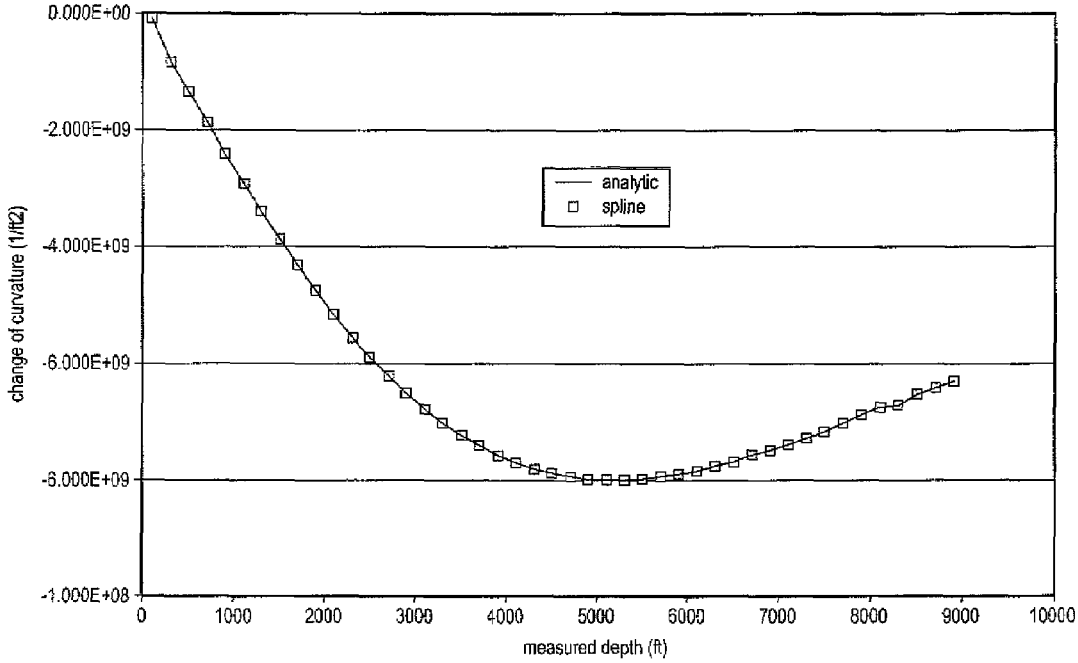
FIG. 5 is a graphical illustration comparing the rate-of-change of curvature between an analytic model and the spline model of the present invention for a catenary wellbore trajectory.
Figure 6:
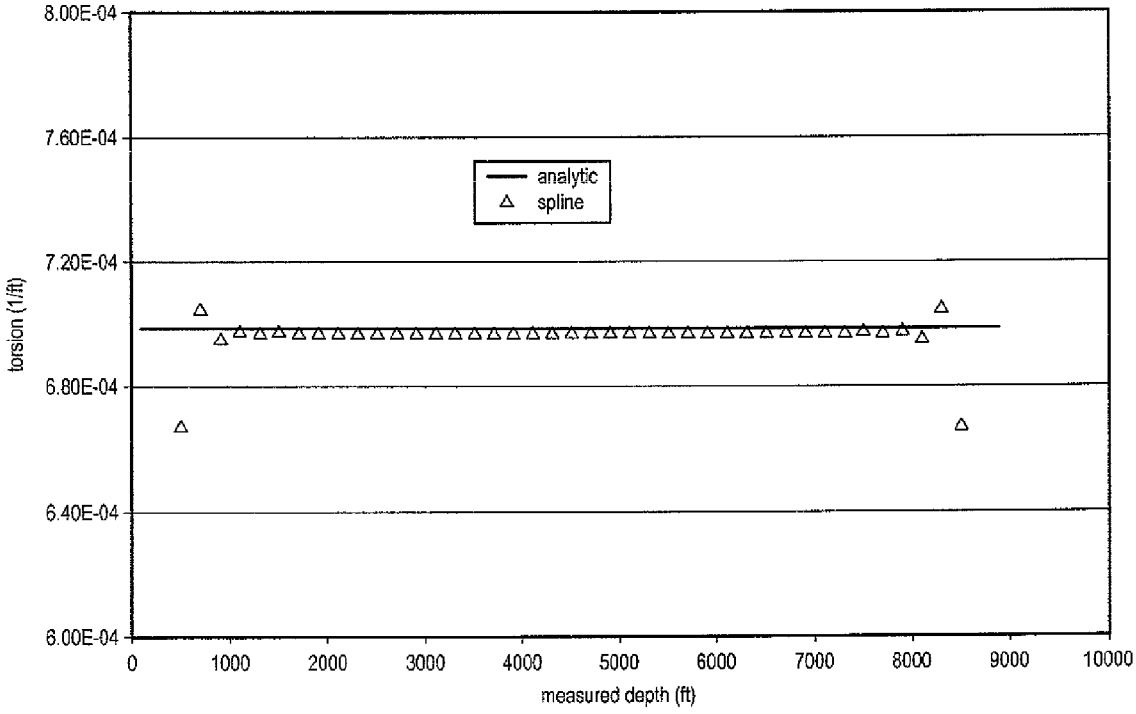
FIG. 6 is a graphical illustration comparing the torsion between an analytic model and the spline model of the present invention for a helix wellbore trajectory.

A simple comparison of the wellbore trajectory model of the present invention, also referred to as a spline model, and the standard minimum curvature model with three analytic wellbore trajectories (circular-arc, catenary, helix) is illustrated in FIGS. 2-4, respectively. The comparisons of the displacements illustrated in FIGS. 2-4 demonstrate that the minimum curvature model and the spline model match the analytic wellbore trajectory in FIG. 2 (circular-arc), the analytic wellbore trajectory in FIG. 3 (catenary) and the analytic wellbore trajectory in FIG. 4 (helix). Only one displacement is shown for the helix, but is representative of the other displacements. The spline model was also used to calculate the rate of change of curvature for the analytic wellbore trajectory illustrated in FIG. 5 (catenary), and the geometric torsion for the analytic wellbore trajectory illustrated in FIG. 6 (helix). Despite the results of the simple comparison illustrated in FIGS. 2-4, the results illustrated by the comparisons in FIGS. 5-6 demonstrate the deficiencies of the minimum curvature model when calculating the curvature rate of change for the catenary wellbore trajectory illustrated in FIG. 5 or when calculating the geometric torsion for the helix wellbore trajectory illustrated in FIG. 6. The minimum curvature model predicts zero for both quantities compared in FIGS. 5-6, which cannot be plotted. The spline model, however, determines both quantities accurately, although there is some end effect apparent in the geometric torsion calculation. Additional advantages attributed to the present invention (spline model) are demonstrated by the following examples.

Torque-Drag Calculations

Torque-drag calculations were made using a comprehensive torque-drag model well known in the art. Similarly, the equilibrium equations were integrated using a method well known in the art. Otherwise, the only difference in the solutions is the choice of the trajectory model.

EXAMPLE 1

Figure 7:
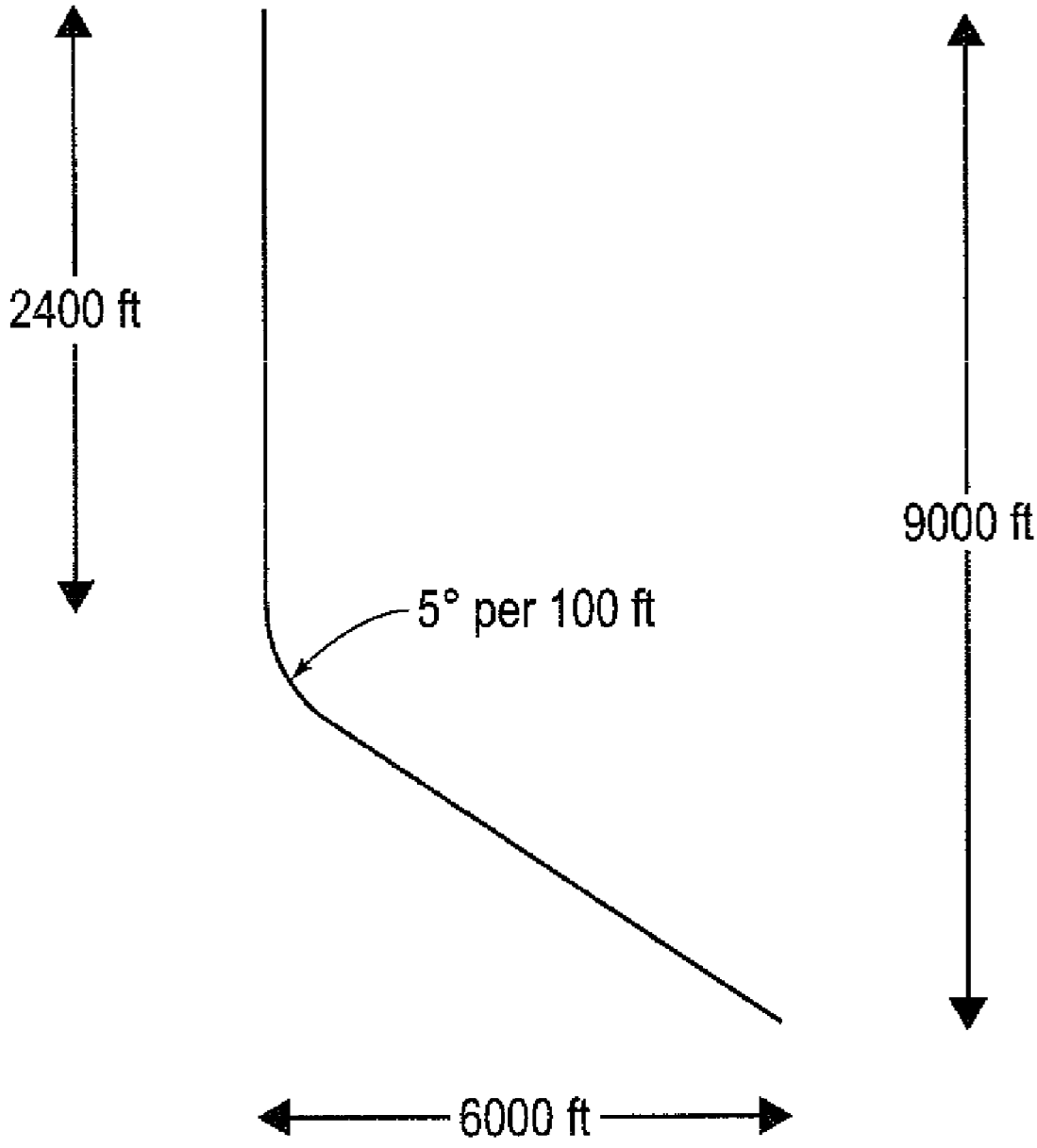
FIG. 7 illustrates the test case wellbore used in Example 1.

In this example, the drag and torque properties of an idealized well plan are based on Well 3 described in Society of Petroleum Engineers article "Designing Well Paths to Reduce Drag and Torque" by Sheppard, M. C., Wick, C. and Burgess, T. M. Referring now to FIG. 7, the fixed points on the model trajectory are as follows: i) the well is considered to be drilled vertically to a KOP at a depth of 2,400 ft.; ii) the inclination angle then builds at a rate of 5°/100 ft; and iii) the target location is considered to be at a vertical depth of 9,000 ft and displaced horizontally from the rig location by 6,000 ft. Drilled as a conventional build-tangent well, this would correspond to a 44.5° well deviation. The model drillstring was configured with 372 feet of 6½ inch drill collar (99.55 lbf./ft.) and 840 ft of 5 inch heavyweight pipe (50.53 lbf./ft.) with 5 inch drillpipe (20.5 lbf./ft.) to the surface. A mud weight of 9.8 lbm/gal was used. In this example, a value of 0.4 was chosen for the coefficient of friction to simulate severe conditions. Torque-loss calculations were made with an assumed WOB of 38,000 lbf. and with an assumed surface torque of 24,500 ft.-lbf.

Figure 8:
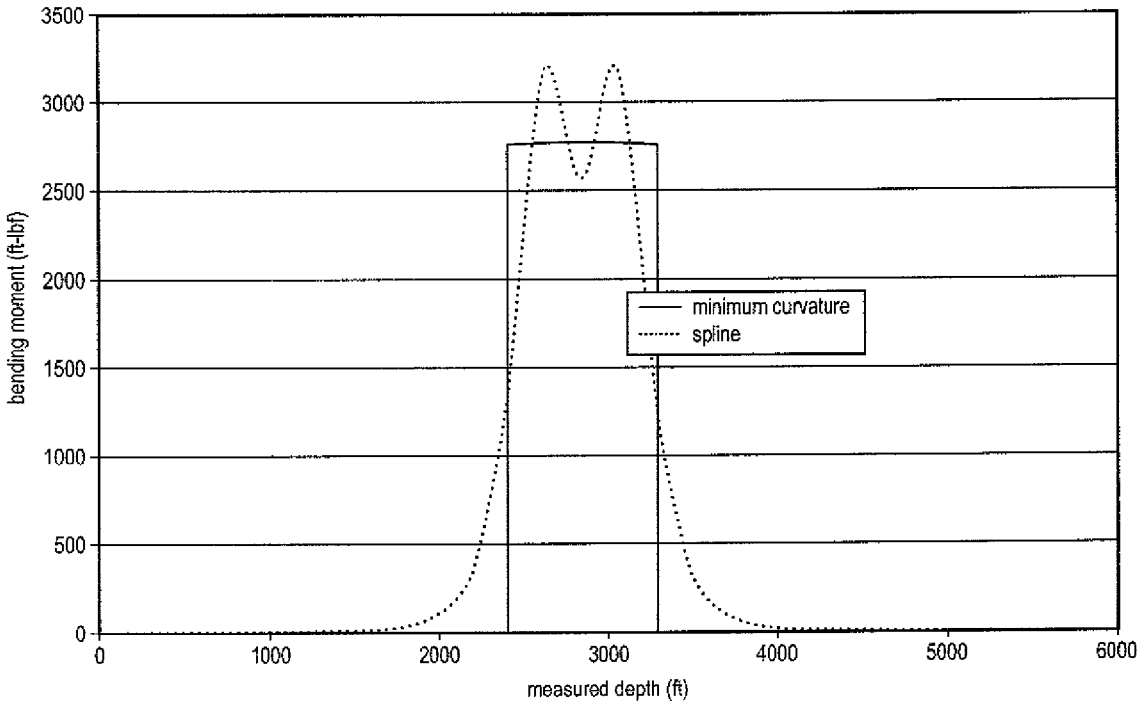
FIG. 8 is a graphical illustration comparing the bending moment between the minimum curvature model and the spline model of the present invention for the test case wellbore used in Example 1.

Hook load calculated for zero friction was 192202 lbf. for the circular-arc calculation, and 192164 lbf for the spline model, which compare to a spreadsheet calculation of 192203 lbf. The slight difference (38 lbf.) is due to the spline taking on a slightly different shape (due to smoothness requirements) from the straight-line/circular-arc shapes specified, which the minimum curvature model exactly duplicated. Other than the slight difference in the spline trajectory, all other aspects of the axial force calculations are identical between the two models. Tripping out, with a friction coefficient of 0.4, the hook load was 313474 lbf for the circular-arc model and 319633 lbf for the spline model, for a difference of 6159 lbf. If calculations are from the zero friction base line, this represents a difference of 5% in the axial force loading. With a surface torque of 24,500 ft-lbs., the torque at the bit was 3333 ft-lbs. for the minimum curvature model and 2528 ft-lbs. for the spline model. This represents a 4% difference in the distributed torque between the two models. The bending moments for the drillstring through the build section are illustrated in FIG. 8. Notably, the minimum curvature does give a lower bending moment than the spline, but that the spline results are much smoother.

Since this case has a relatively mild build rate, and since the build section was only about 8% of the total well depth, it would be expected that a relatively small effect from the spline formulation would be seen. Because the classic torque-drag analysis has historically given good results, the agreement of the two models for this case verifies that the overall formulation is correct.

EXAMPLE 2

Figure 9A:
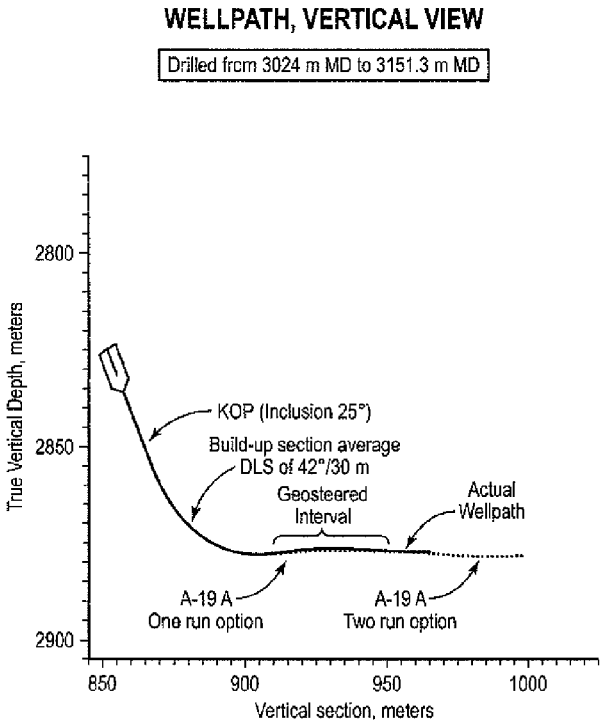
FIG. 9A is a graphical illustration (vertical view) of the short radius wellpath used in Example 2.
Figure 9B:
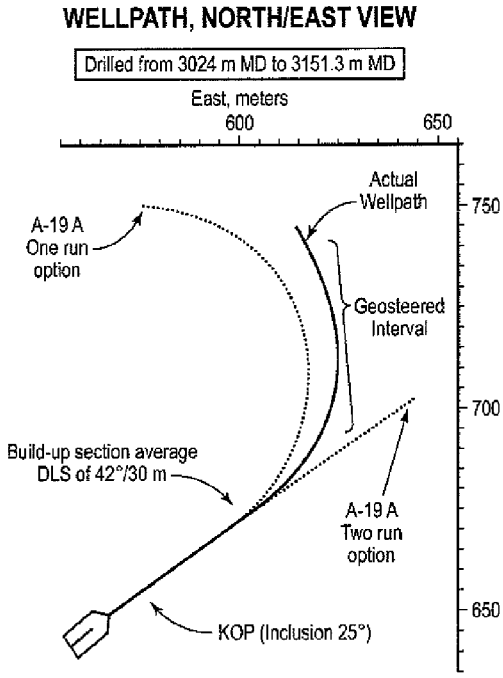
FIG. 9B is a graphical illustration (North/East view) of the short radius wellpath used in Example 2.
Figure 10:
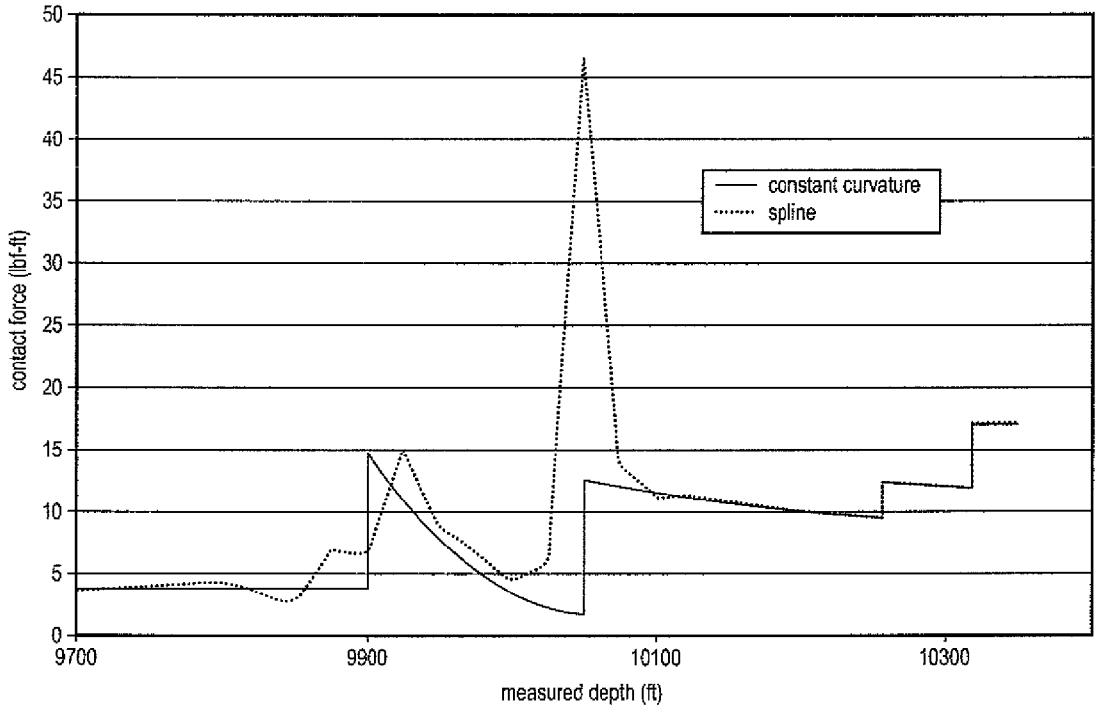
FIG. 10 is a graphical illustration comparing the short radius contact force between a constant curvature model and the spline model of the present invention for the wellpath used in Example 2.
Figure 11:
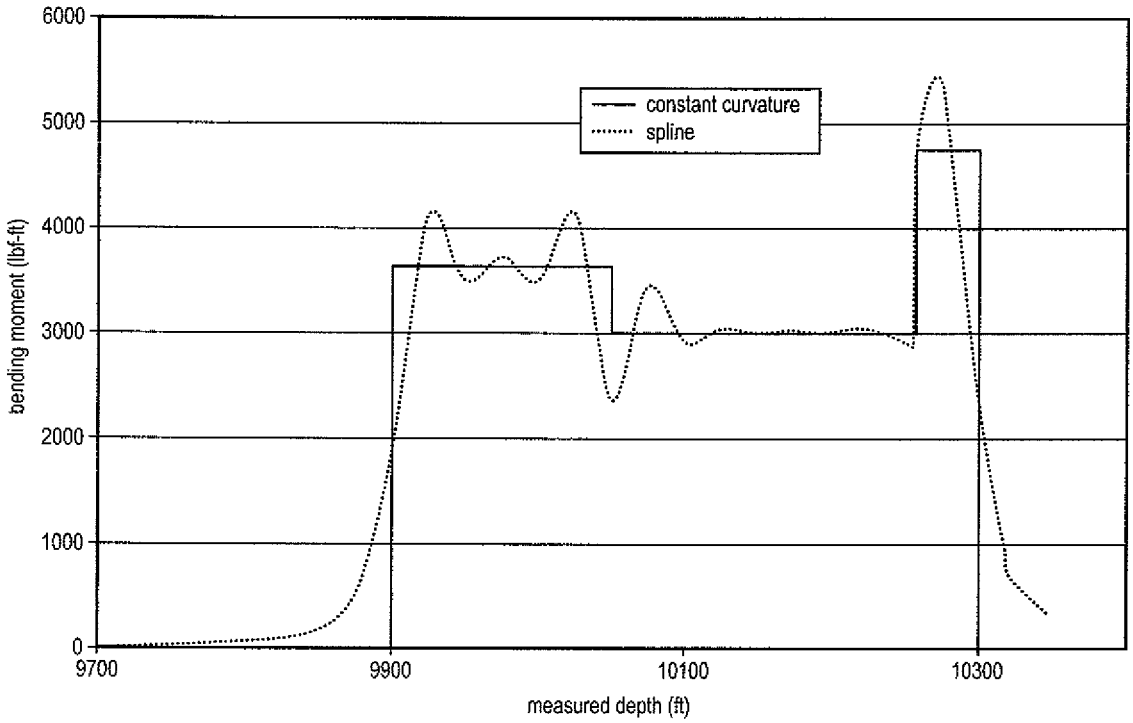
FIG. 11 is a graphical illustration comparing the short radius bending moment between a constant curvature model and the spline model of the present invention for the wellpath used in Example 2.

For a more demanding example, the short-radius wellbore described in the Society of Petroleum Engineers article "Short Radius TTRD Well with Rig Assisted Snubbing on the Veslefrikk Field" by Grinde, Jan, and Haugland, Torstein was used. Referring now to FIGS. 9A and 9B, the vertical and horizontal views of the end of the wellpath are illustrated, respectively. The build rate for this example was 42°/30 m, roughly ten times the build rate of the first case in Example 1. As illustrated in FIG. 10, some of the contact force is neglected by neglecting the bending moment since the contact force for the spline model at the end of the build is four times that of the minimum curvature model. In FIG. 11, the bending moment for this example is illustrated. The minimum curvature model still provides a lower bending moment than the spline model, but the spline results are still much smoother.

Figure 12:
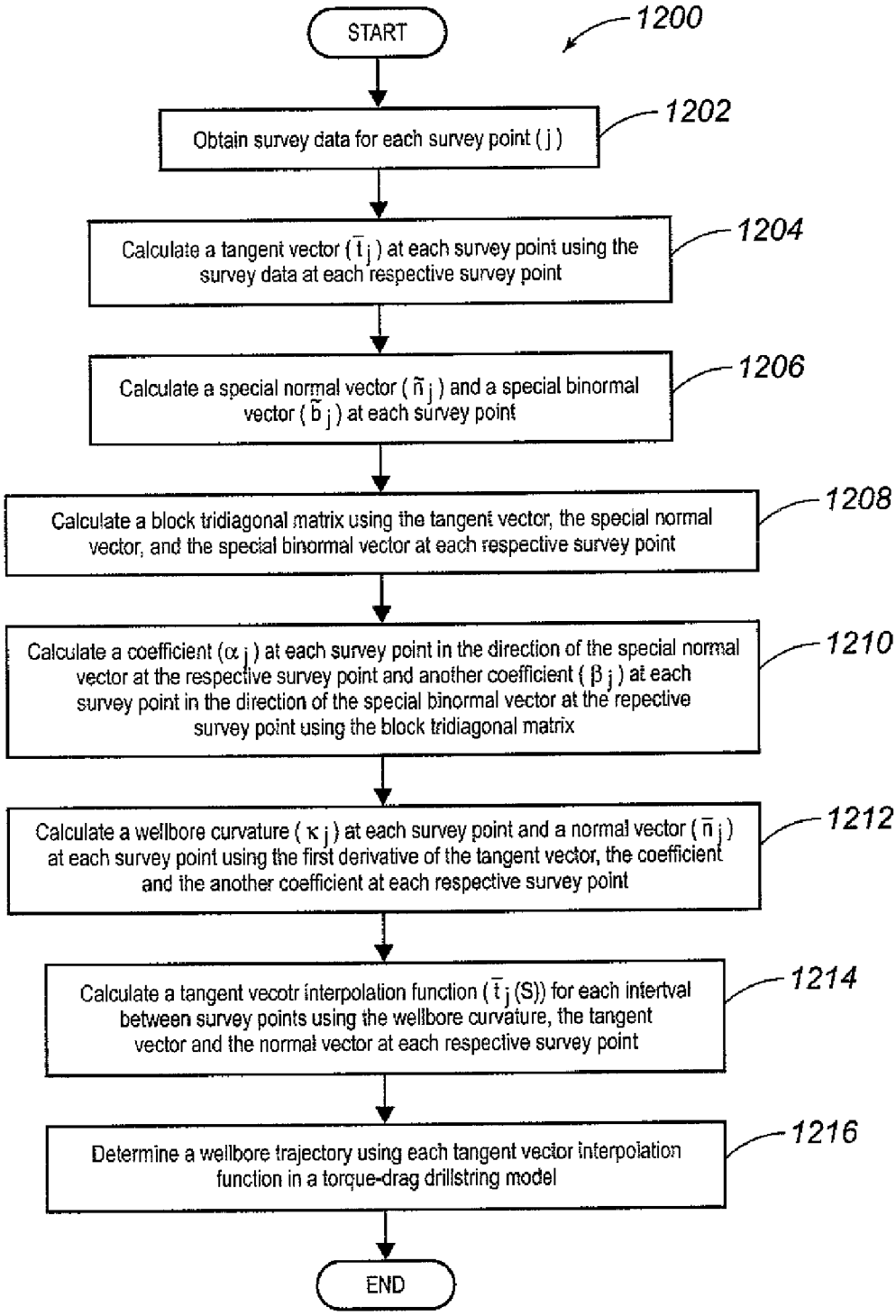
FIG. 12 is a flow diagram illustrating one embodiment of a method for implementing the present invention.

Referring now to FIG. 12, flow diagram illustrates one embodiment of a method 1200 for implementing the present invention.

In step 1202, the survey data is obtained for each survey point (j).

In step 1204, a tangent vector ($\vec{t}_j$) is calculated at each survey point using the survey data at each respective survey point.

In step 1206, a special normal vector ($\tilde{n}_j$) and a special binormal vector ($\tilde{b}_j$) are calculated at each survey point.

In step 1208, a block tridiagonal matrix is calculated using the tangent vector, the special normal vector and the special binormal vector at each respective survey point.

In step 1210, a coefficient ($\alpha_j$) is calculated at each survey point in the direction of the special normal vector at the respective survey point and another coefficient ($\beta_j$) is calculated at each survey point in the direction of the special binormal vector at the respective survey point using the block tridiagonal matrix.

In step 1212, a wellbore curvature ($\kappa_j$) and a normal vector ($\vec{n}_j$) are calculated at each survey point using a first derivative of the tangent vector, the coefficient and the another coefficient at each respective survey point.

In step 1214, a tangent vector interpolation function ($\vec{n}_j(s)$) is calculated for each interval between survey points using the wellbore curvature, the tangent vector and the normal vector at each respective survey point.

In step 1216, the wellbore trajectory is determined using each tangent vector interpolation function in a torque-drag drillstring model.

While the present invention has been described in connection with presently preferred embodiments, it will be understood by those skilled in the art that it is not intended to limit the invention to those embodiments. The present invention, for example, may also be applied to model other tubular trajectories, which are common in chemical plants and manufacturing facilities. It is therefore, contemplated that various alternative embodiments and modifications may be made to the disclosed embodiments without departing from the spirit and scope of the invention defined by the appended claims and equivalents thereof.

The invention claimed is:

1. A computer implemented method for modeling a wellbore trajectory, comprising:

calculating a tangent vector interpolation function for each interval between two or more survey points within a wellbore using a wellbore curvature, a tangent vector and a normal vector at each respective survey point; and determining the wellbore trajectory using a computer processor and each tangent vector interpolation function in a torque-drag drillstring model.

2. The method of claim 1, further comprising:

calculating the tangent vector at each survey point using survey data at each respective survey point.

3. The method of claim 2, wherein the survey data comprises an inclination angle, an azimuth angle and a measured depth at each survey point.

4. The method of claim 1, further comprising:

calculating the wellbore curvature at each survey point using a first derivative of the tangent vector, a coefficient and another coefficient at each respective survey point; and calculating the normal vector at each survey point using the first derivative of the tangent vector, the coefficient and the another coefficient at each respective survey point.

5. The method of claim 4, wherein the first derivative of the tangent vector is continuous at each survey point.

6. The method of claim 4, further comprising:

calculating the coefficient at each survey point in a direction of a special normal vector at the respective survey point using a block tridiagonal matrix; and calculating the another coefficient at each survey point in a direction of a special binormal vector at the respective survey point using the block tridiagonal matrix.

7. The method of claim 6, further comprising:

calculating the block tridiagonal matrix using the tangent vector, the special normal vector, and the special binormal vector at each respective survey point.

8. The method of claim 6, further comprising:

calculating the special normal vector at each survey point; and calculating the special binormal vector at each survey point.

9. The method of claim 1, further comprising:

calculating a torque-drag drillstring solution using the wellbore trajectory.

10. The method of claim 9, further comprising:

refining the wellbore trajectory using the torque-drag drillstring solution.

11. A non-transitory computer readable medium having computer executable instructions for modeling a wellbore trajectory, the instructions being executable to implement:

calculating a tangent vector interpolation function for each interval between two or more survey points within a wellbore using a wellbore curvature, a tangent vector and a normal vector at each respective survey point; and determining the wellbore trajectory using each tangent vector interpolation function in a torque-drag drillstring model.

12. The computer readable medium of claim 11, further comprising:

calculating the tangent vector at each survey point using survey data at each respective survey point.

13. The computer readable medium of claim 12, wherein the survey data comprises an inclination angle, an azimuth angle and a measured depth at each survey point.

14. The computer readable medium of claim 11, further comprising:

calculating the wellbore curvature at each survey point using a first derivative of the tangent vector, a coefficient and another coefficient at each respective survey point; and calculating the normal vector at each survey point using the first derivative of the tangent vector, the coefficient and the another coefficient at each respective survey point.

15. The computer readable medium of claim 14, wherein the first derivative of the tangent vector is continuous at each survey point.

16. The computer readable medium of claim 14, further comprising:

calculating the coefficient at each survey point in a direction of a special normal vector at the respective survey point using a block tridiagonal matrix; and calculating the another coefficient at each survey point in a direction of a special binormal vector at the respective survey point using the block tridiagonal matrix.

17. The computer readable medium of claim 16, further comprising:

calculating the block tridiagonal matrix using the tangent vector, the special normal vector, and the special binormal vector at each respective survey point.

18. The computer readable medium of claim 16, further comprising:

calculating the special normal vector at each survey point; and calculating the special binormal vector at each survey point.

19. The computer readable medium of claim 11, further comprising:

calculating a torque-drag drillstring solution using the wellbore trajectory.

20. The computer readable medium of claim 19, further comprising:

refining the wellbore trajectory using the torque-drag drillstring solution.

21. A computer implemented method for modeling a wellbore trajectory, comprising:

calculating a tangent vector at each survey point within a wellbore using survey data at each respective survey point, the wellbore comprising two or more survey points;

calculating a special normal vector and a special binormal vector at each survey point;

calculating a block tridiagonal matrix using the tangent vector, the special normal vector, and the special binormal vector at each respective survey point;

calculating a coefficient at each survey point in the direction of the special normal vector at the respective survey point and another coefficient at each survey point in the direction of the special binormal vector at the respective survey point using the block tridiagonal matrix;

calculating a wellbore curvature at each survey point and a normal vector at each survey point using a first derivative of the tangent vector, the coefficient and the another coefficient at each respective survey point;

calculating a tangent vector interpolation function for each interval between the survey points using the wellbore curvature, the tangent vector and the normal vector at each respective survey point; and determining the wellbore trajectory using a computer processor and each tangent vector interpolation function in a torque-drag drillstring model.

22. The method of claim 21, wherein $$\tilde{n}_j = \begin{bmatrix} \cos\varphi_j \cos\vartheta_j \\ \cos\varphi_j \sin\vartheta_j \\ -\sin\varphi_j \end{bmatrix}$$

is used to calculate the special normal vector at each survey point.

23. The method of claim 21, wherein $$\tilde{b}_j = \begin{bmatrix} -\sin\vartheta_j \\ \cos\vartheta_j \\ 0 \end{bmatrix}$$

is used to calculate the special binormal vector at each survey point.

24. The method of claim 21, wherein $$\left[\alpha_{j-1}\tilde{n}_j \cdot \tilde{n}_{j-1} + \beta_{j-1}\tilde{n} \cdot \tilde{b}_{j-1}\right]\frac{d^2 f_{2j-1}}{ds^2} + \alpha_j\left(\frac{d^2 f_{2j}}{ds^2} + \frac{d^2 f_{4j-1}}{ds^2}\right) + \left[\alpha_{j+1}\tilde{n}_j \cdot \tilde{n}_{j+1} + \beta_{j+1}\tilde{n}_j \cdot \tilde{b}_{j+1}\right]\frac{d^2 f_{4j}}{ds^2} = \tilde{n}_j \cdot \left(t_{j+1}\frac{d^2 f_{3j}}{ds^2} - t_{j-1}\frac{d^2 f_{1j-1}}{ds^2}\right)$$

is used to calculate the coefficient at each survey point.

25. The method of claim 21, wherein $$\left[\alpha_{j-1}\tilde{b}_j \cdot \tilde{n}_{j-1} + \beta_{j-1}\tilde{b}_j \cdot \tilde{b}_{j-1}\right]\frac{d^2 f_{2j-1}}{ds^2} + \beta_j\left(\frac{d^2 f_{2j}}{ds^2} + \frac{d^2 f_{4j-1}}{ds^2}\right) + \left[\alpha_{j+1}\tilde{b}_j \cdot \tilde{n}_{j+1} + \beta_{j+1}\tilde{b}_j \cdot \tilde{b}_{j+1}\right]\frac{d^2 f_{4j}}{ds^2} = \tilde{b}_j \cdot \left(t_{j+1}\frac{d^2 f_{3j}}{ds^2} - t_{j-1}\frac{d^2 f_{1j-1}}{ds^2}\right)$$

is used to calculate the another coefficient at each survey point.

26. The method of claim 21, wherein $$k_j n_j = \alpha_j \tilde{n}_j + \beta_j \tilde{b}_j$$

is used to calculate the wellbore curvature and the normal vector at each survey point.

27. The method of claim 21, wherein $$\vec{t}_j(s) = \frac{\vec{T}_j(s)}{\sqrt{\vec{T}_j(s) \cdot \vec{T}_j(s)}}$$

is used to calculate each tangent vector interpolation function.

28. The method of claim 21, wherein the survey data comprises an inclination angle, an azimuth angle and a measured depth at each survey point.

29. The method of claim 21, further comprising:

calculating a torque-drag drillstring solution using the wellbore trajectory.

30. The method of claim 29, further comprising:

refining the wellbore trajectory using the torque-drag drillstring solution.

31. A non-transitory computer readable medium having computer executable instructions for modeling a wellbore trajectory, the instructions being executable to implement:

calculating a tangent vector at each survey point within a wellbore using survey data at each respective survey point, the wellbore comprising two or more survey points;

calculating a special normal vector and a special binormal vector at each survey point;

calculating a block tridiagonal matrix using the tangent vector, the special normal vector, and the special binormal vector at each respective survey point;

calculating a coefficient at each survey point in the direction of the special normal vector at the respective survey point and another coefficient at each survey point in the direction of the special binormal vector at the respective survey point using the block tridiagonal matrix;

calculating a wellbore curvature at each survey point and a normal vector at each survey point using a first derivative of the tangent vector, the coefficient and the another coefficient at each respective survey point;

calculating a tangent vector interpolation function for each interval between the survey points using the wellbore curvature, the tangent vector and the normal vector at each respective survey point; and determining the wellbore trajectory using each tangent vector interpolation function in a torque-drag drillstring model.

32. The computer readable medium of claim 31, wherein $$\tilde{n}_j = \begin{bmatrix} \cos\varphi_j \cos\vartheta_j \\ \cos\varphi_j \sin\vartheta_j \\ -\sin\varphi_j \end{bmatrix}$$

is used to calculate the special normal vector at each survey point.

33. The computer readable medium of claim 31, wherein $$\tilde{b}_j = \begin{bmatrix} -\sin\vartheta_j \\ \cos\vartheta_j \\ 0 \end{bmatrix}$$

is used to calculate the special binormal vector at each survey point.

34. The computer readable medium of claim 31, wherein $$\left[\alpha_{j-1}\tilde{n}_j \cdot \tilde{n}_{j-1} + \beta_{j-1}\tilde{n}_j \cdot \tilde{b}_{j-1}\right]\frac{d^2 f_{2j-1}}{ds^2} + \alpha_j\left(\frac{d^2 f_{2j}}{ds^2} + \frac{d^2 f_{4j-1}}{ds^2}\right) + \left[\alpha_{j+1}\tilde{n}_j \cdot \tilde{n}_{j+1} + \beta_{j+1}\tilde{n}_j \cdot \tilde{b}_{j+1}\right]\frac{d^2 f_{4j}}{ds^2} = \tilde{n}_j \cdot \left(t_{j+1}\frac{d^2 f_{3j}}{ds^2} - t_{j-1}\frac{d^2 f_{1j-1}}{ds^2}\right)$$

is used to calculate the coefficient at each survey point.

35. The computer readable medium of claim 31, wherein $$\left[\alpha_{j-1}\tilde{b}_j\cdot\tilde{n}_{j-1}\tilde{n}_j+\beta_{j-1}\tilde{b}_j\cdot\tilde{b}_{j-1}\right]\frac{d^2 f_{2j-1}}{ds^2}+\beta_j\left(\frac{d^2 f_{2j}}{ds^2}+\frac{d^2 f_{4j-1}}{ds^2}\right)+\left[\alpha_{j+1}\tilde{b}_j\cdot\tilde{n}_{j+1}+\beta_{j+1}\tilde{b}_j\cdot\tilde{b}_{j+1}\right]\frac{d^2 f_{4j}}{ds^2}=\tilde{b}_j\cdot\left(t_{j+1}\frac{d^2 f_{3j}}{ds^2}-t_{j-1}\frac{d^2 f_{1j-1}}{ds^2}\right)$$

is used to calculate the another coefficient at each survey point.

36. The computer readable medium of claim 31, wherein $$k_j n_j = a_j \tilde{n}_j + \beta_j \tilde{b}_j$$

is used to calculate the wellbore curvature and the normal vector at each survey point.

37. The computer readable medium of claim 31, wherein $$\vec{t}_j(s)=\frac{\vec{T}_j(s)}{\sqrt{\vec{T}_j(s)\cdot\vec{T}_j(s)}}$$

is used to calculate each tangent vector interpolation function.

38. The computer readable medium of claim 31, wherein the survey data comprises an inclination angle, an azimuth angle and a measured depth at each survey point.

39. The computer readable medium of claim 31, further comprising:

calculating a torque-drag drillstring solution using the wellbore trajectory.

40. The computer readable medium of claim 39, further comprising:

refining the wellbore trajectory using the torque-drag drillstring solution.

* * * * *